US007596333B2

(12) United States Patent
Kasiske et al.

(10) Patent No.: US 7,596,333 B2
(45) Date of Patent: Sep. 29, 2009

(54) OPTIMIZING A PRINTING PROCESS FOR SUBSEQUENT FINISHING PROCEDURE

(75) Inventors: W. Charles Kasiske, Penfield, NY (US); John L. Hryhorenko, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 810 days.

(21) Appl. No.: 11/338,308

(22) Filed: Jan. 24, 2006

(65) Prior Publication Data

US 2007/0171437 A1 Jul. 26, 2007

(51) Int. Cl.
*G03G 15/20* (2006.01)

(52) U.S. Cl. ..... 399/67; 399/69; 399/341

(58) Field of Classification Search ..... 399/38, 399/45, 67, 69, 320, 341, 342, 407
See application file for complete search history.

(56) References Cited

U.S. PATENT DOCUMENTS 5,956,543 A * 9/1999 Aslam et al. ..... 399/45
6,006,668 A * 12/1999 Rehmann ..... 101/484
6,322,208 B1 * 11/2001 Bugner et al. ..... 347/104
2004/0183880 A1 9/2004 Kito ..... 347/101
2005/0244181 A1 11/2005 Bobo et al. ..... 399/67

* cited by examiner

*Primary Examiner*—Hoan H Tran
(74) *Attorney, Agent, or Firm*—Justin D. Petruzzelli

(57) ABSTRACT

In a system and a method for optimizing a printing process, toner adhesion information is acquired that identifies a toner adhesion characteristic of a printed image. The toner adhesion information may identify at least one of (a) a characteristic of toner voids present in the test print, and (b) a relative indication of how easily toner may be removed from the test print. Based at least upon the toner adhesion information, a fuser pressure, a fuser temperature, or both are adjusted ("print job adjustment"). The print job adjustment is used for printing a print job prior to performing a finishing procedure on the print job. The print job adjustment improves an image quality of the print job subsequent to the finishing procedure.

20 Claims, 7 Drawing Sheets

PRESS FUSING SETPOINT ADJUSTMENTS

| | | | OFFSET, NO SCRATCH TEST NEEDED | | NO OFFSET; COIN SCRATCH RESULTS | | |
|---|---|---|---|---|---|---|---|
| | | | LARGE OR MANY DENSITY VOIDS* (SEE PICTURE 1 IN APPENDIX) | SMALL OR FEW DENSITY VOIDS* (SEE PICTURE 2 IN APPENDIX) | DRYINK SCRATCHES OFF EASILY (SEE PICTURE 3 IN APPENDIX) | DRYINK DIFFICULT TO SCRATCH OFF | DRYINK DOES NOT SCRATCH OFF |
| LOWEST TEMPERATURE IS... | ABOVE TARGET: MORE THAN 3°C | NIP WIDTH | INCREASE BY 3000μm | INCREASE BY 1000μm | NO ADJUSTMENT | DECREASE BY 500μm | DECREASE BY 1000μm |
| | | ENERGY FLOW | INCREASE BY 50W | DECREASE BY 150W | DECREASE BY 250W | DECREASE BY 300W | DECREASE BY 350W |
| | WITHIN 3°C OF TARGET | NIP WIDTH | INCREASE BY 3000μm | INCREASE BY 1000μm | NO ADJUSTMENTS | DECREASE BY 500μm | DECREASE BY 2000μm |
| | | ENERGY FLOW | INCREASE BY 300W | INCREASE BY 100W | | DECREASE BY 50W | DECREASE BY 200W |
| | BELOW TARGET; MORE THAN 3°C | NIP WIDTH | INCREASE BY 3000μm | INCREASE BY 1000μm | NO ADJUSTMENT | DECREASE BY 500μm | DECREASE BY 1000μm |
| | | ENERGY FLOW | INCREASE BY 550W | INCREASE BY 350W | INCREASE BY 250W | INCREASE BY 200W | INCREASE BY 150W |

RELATIONSHIPS: 1C=50W 1mm=100W

*FIG. 8*

OPTIMIZING A PRINTING PROCESS FOR SUBSEQUENT FINISHING PROCEDURE

FIELD OF THE INVENTION

This invention relates to optimizing a printing process for a subsequent finishing procedure. In particular, this invention relates to optimizing an electrophotographic printing process so that a print job printed by the printing process has toner characteristics suitable for a subsequent finishing procedure.

BACKGROUND OF THE INVENTION

Electrophotographic ("EP") printing involves transferring toner, or dry ink, to a substrate, such as paper, by means of an electric field and then fusing the toner to the substrate using a combination of heat and pressure. After fusing, the substrate is cooled, and excess charge is removed from the substrate. Conventionally, a release fluid is used during the fusing process to provide release of the substrate from the fusing roller. After fusing, cooling, and removing excess charge, the substrate exits the EP printing device, thereby completing the printing process. The substrate having an image fused thereon by an EP printing process is referred to as a "printed document" and may contain text, one or more images, or both.

Commonly, the printed document subsequently is subjected to a finishing procedure. Examples of finishing procedures include glossing, coating using ultraviolet ("UV") radiation, and lamination. In the case of glossing, the printed document is subjected to a procedure that heats and casts the fused toner on the printed document to give it a glossy appearance. In the case of coating using UV radiation, the printed document is coated with a UV curable fluid and exposed to such UV radiation. In the case of lamination, a coating, such as plastic, is applied to the printed document and is heated under pressure to form a protective coating over the printed document.

During each of these finishing procedures, performance and/or quality problems arise if there is a significant amount of release fluid remaining on the printed document when the finishing procedure is performed. These problems will be described in more detail with reference to FIG. 1. Illustration 101 shows an arrangement of toner particles 102 on a substrate 103 prior to being fused. Illustration 104 shows toner particles 105 that have been over-fused to the substrate 103. In particular, the toner particles 105 have been fused to form a mostly continuous layer. In this case, the release fluid 106 cannot migrate into the substrate 103. Consequently, the release fluid 106 sits on top of the over-fused toner particles 105 and becomes a problem for downstream processes, such as subsequent finishing procedures.

For example, if a glossing procedure is applied to the over-fused printed document illustrated at 104, the release fluid will interact with the polishing device in the glossing apparatus, thereby degrading performance. If a UV coating is applied to the substrate 103 having the over-fused toner 105 and release fluid 106 thereon, as illustrated at 104, the UV curable material may not adequately coat the image thereby resulting in image quality artifacts and non-uniform image protection. If a laminate coating is applied on top of the over-fused toner 105, the laminate forms on top of the release fluid 106 causing artifacts, such as rivers or lakes, or poor adhesion of the laminate to the image.

Illustration 107 shows properly-fused toner particles 108 that, although adhered to the substrate 103, have seams 109 between them, that allow release fluid (not shown) to migrate into the substrate 103. Accordingly, the release fluid (not shown in illustration 107) does not sit on top of the properly-fused toner particles 108 and does not become a problem for downstream finishing processes.

It has been difficult conventionally to ensure that proper-fusing of toner particles as shown in illustration 107 occurs for subsequent finishing procedures, particularly because proper-fusing is dependent upon many variables. Accordingly, a need in the art exists for an optimized printing process that reliably provides proper-fusing for subsequent finishing procedures.

SUMMARY OF THE INVENTION

The above-described problem is addressed and a technical solution is achieved in the art by a system and a method for optimizing a printing process, according to the present invention. In an embodiment of the present invention, toner adhesion information is acquired that identifies a toner adhesion characteristic of a printed image. The toner adhesion information is used to make one or more fusing adjustments to ensure proper fusing characteristics of a print job to be subjected to a subsequent finishing procedure.

According to an embodiment of the present invention, a fuser pressure, a fuser temperature, or both is/are adjusted based at least upon the toner adhesion information. Such adjustment(s) is/are referred to as "a print job adjustment." The print job adjustment is used for printing a print job prior to performing a finishing procedure on the print job. The print job adjustment improves, among other things, a performance of the subsequent finishing procedure when performed on the print job. Examples of the finishing procedure include, but are not limited to, a glossing procedure, a UV coating procedure, and a lamination procedure.

In another embodiment of the present invention, the printed image may be a test print produced prior to printing the print job, and the toner adhesion information may identify at least one of (a) a characteristic of toner voids present in the test print, and (b) a relative indication of how easily toner may be removed from the test print.

According to a further embodiment of the present invention, parameter information may be acquired to improve the process of ensuring proper toner fusing of a print job prior to being subjected to a subsequent finishing procedure. In this embodiment, the parameter information identifies at least one of a substrate weight, a substrate type, a substrate surface type, and a type of finishing procedure to be performed as the subsequent finishing procedure. The parameter information may be used to identify an adjustment ("test print adjustment") to a fuser pressure, a fuser discharge level, or both, to be used for performing the test print. In this embodiment, the print job adjustment made based at least upon the toner adhesion information may further refine the test print adjustment made based at least upon the parameter information.

According to still another embodiment of the present invention, a fuser temperature is measured during printing of the test print. The fuser temperature may be monitored or measured at a time or during a period of time when an approximately minimum fuser temperature occurs or is expected to occur. Temperature information is generated by comparing the monitored or measured fuser temperature to a target fuser temperature. According to this embodiment, the print job adjustment is determined based at least upon the toner adhesion information and the temperature information. Also according to this embodiment, the print job adjustment includes an adjustment to a fuser temperature to be used during printing of the print job based at least upon the temperature information.

The above described inventive processes may be implemented in various systems, apparatuses, and instructions stored in one or more computer-accessible memories. Such instructions may be embodied as software and/or firmware ultimately executed by one or more computers, or may be embodied as a set of instructions for a user in a computer-readable document, such as, for example, without limitation, an Adobe™ PDF document, a Microsoft Word™ document, a Microsoft Excel™ document, etc.

In addition to the embodiments described above, further embodiments will become apparent by reference to the drawings and by study of the following detailed description.

BRIEF DESCRIPTION OF THE DRAWINGS

The present invention will be more readily understood from the detailed description of exemplary embodiments presented below considered in conjunction with the attached drawings, of which:

FIG. 8 illustrates press setting adjustments made to provide proper toner adhesion characteristics, according to an embodiment of the present invention.

Figure 1:
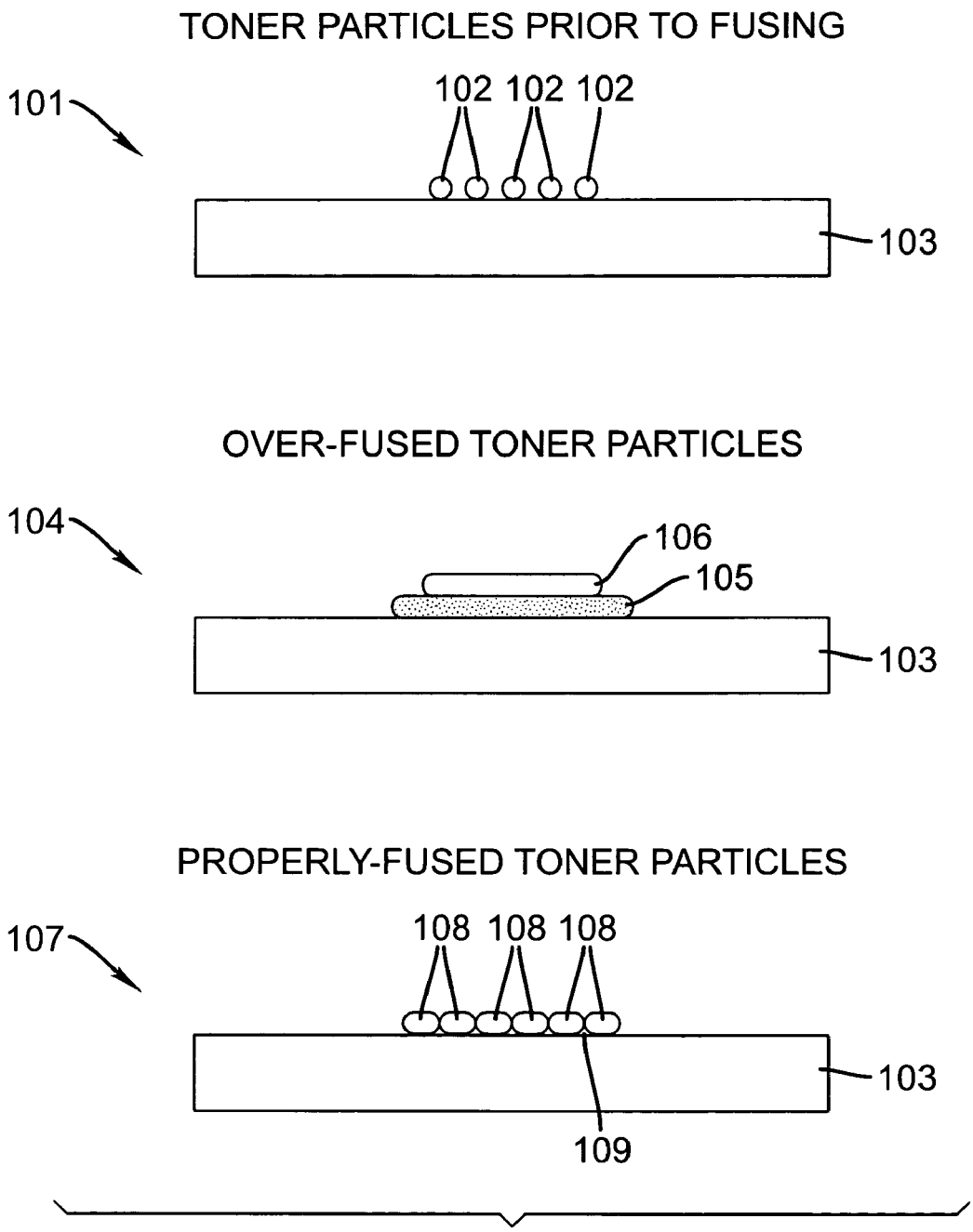
FIG. 1 illustrates various fusing states of toner particles.

It is to be understood that the attached drawings are for purposes of illustrating the concepts of the invention and may not be to scale.

DETAILED DESCRIPTION

It should be noted that the phrase "over-fused," as used in this description, actually refers to a fully fused state, i.e., a state in which toner particles have been fused to form a mostly continuous layer. However, because this state causes problems when subsequent finishing procedures, such as glossing, UV radiation coating, and lamination, this state is referred to as an "over-fused" state. Further, the phrase, "properly-fused," as used in this description, refers to a semi-fused state in which toner particles have not been fused to form a mostly continuous layer. Ideally, the properly-fused state, as referred to in reference to the present invention, is a state in which the toner particles adhere to a substrate without any density voids (i.e., areas where toner failed to adhere to the substrate and, consequently, is not present in such areas on the substrate) and are easily scratched off.

Embodiments of the present invention ensure proper fusing of toner in a print job, so that when a finishing procedure is performed on the print job, negative effects due to release fluid build-up are eliminated or reduced. According to the various embodiments of the present invention, this result is achieved by making initial press setting adjustments (or "test print adjustment(s)"), including fusing adjustments, based upon at least one of a substrate characteristic and the type of finishing procedure to apply. According to an embodiment of the present invention, the substrate characteristic is a substrate weight, a substrate type, or a substrate surface type.

According to various embodiments of the present invention, a test print is printed by an EP printing device using the test print adjustment(s). During the test print, a fuser temperature of the EP printing device is measured. The test print is inspected to determine its toner adhesion characteristics. For example, without limitation, the test print is inspected for toner voids, how easily the toner scratches off, or both. Based upon the inspected toner adhesion characteristic(s) and the measured fuser temperature during the test print, one or more additional adjustments (or "print job adjustment(s)") are made to the press settings. At least the print job adjustment(s) is/are used to perform printing of an actual print job from the EP printing device, such that the print job, when printed, exhibits appropriately fused toner for the subsequent finishing procedure. Consequently, the various embodiments of the present invention provide a way to easily and consistently produce print jobs with appropriately fused toner for a subsequent finishing procedure. According to an embodiment of the present invention, examples of the subsequent finishing procedure include a glossing procedure, a UV coating procedure, and a lamination procedure. The apparatuses and processes according to the various embodiments of the present invention apply to both color printing and black and white printing.

The present invention will be described in more detail with reference to the embodiment of FIG. 2, which illustrates an EP printing apparatus 200. An example of the EP printing apparatus 200 is the NexPress 2100™. The apparatus 200 includes a paper path 202 upon which a substrate 204 is propagated through the apparatus 200. The substrate 204 has toner (not shown) at least on its face-up side and enters the apparatus 200 from the left-hand side of FIG. 2. The substrate 204 passes through and is subjected to pressure by a fuser roller 206 and a pressure roller 208. The fuser roller 206 and the pressure roller 208 each typically have an aluminum core 210 and 212, respectively, and a rubber exterior 214 and 216, respectively. The aluminum core 210 of the fuser roller 206 typically is heated by an internal lamp 218 so that the surface of the rubber exterior 214 is at a temperature of about 170° C. The aluminum core 212 of the pressure roller 208 typically is heated by an internal lamp 220 so that the surface of the rubber exterior 216 is at a temperature of about 90° C.

The fuser roller 206 and the pressure roller 208 press against each other through the paper path 202. The amount of pressure produced by the contacting of the fuser roller 208 and the pressure roller 208 is indicated by the nipwidth 222, which is the length of a contacting portion of the rubber exteriors 214, 216 of the fuser roller 206 and the pressure roller 208, respectively. The nipwidth 222 also indicates how long the substrate 204 is subjected to the pressure caused by the contacting fuser roller 206 and the pressure roller 208. When the substrate 204 enters the region between the contacted fuser roller 206 and the pressure roller 208, the toner on the substrate 204 is fused due to pressure and heat from the fuser roller 206 and the pressure roller 208. A silicone fuser fluid is generally applied to the surface of the fuser roller 206 to allow release of the toner from the surface of the fuser roller 206. The amount of time the toner is fused is dependent upon the nipwidth 222 and the speed of the substrate 204. As discussed above, it is critical that the toner be properly fused for subsequent finishing procedures, and, therefore, the present invention controls one or more of the factors described above which affect fusing of the toner.

After the substrate 204 has been subjected to fusing, it enters a cooling device 224 that blows air onto the substrate 204 to cool it. After cooling, the substrate 204 enters a discharging device 226 that removes static charge from the substrate 204 having fused toner thereon. The less fused the toner is, the more charge is on it, and the more charge must be removed from it by the discharging device 226. Conversely, the more fused the toner is, the less charge is on it, and the less charge must be removed from it by the discharging device 226. Accordingly, an embodiment of the present invention controls settings used for the discharging device 226 to ensure that it removes a proper amount of charge for adequate paper handling and/or for proper performance of the subsequent finishing procedure.

Figure 2:
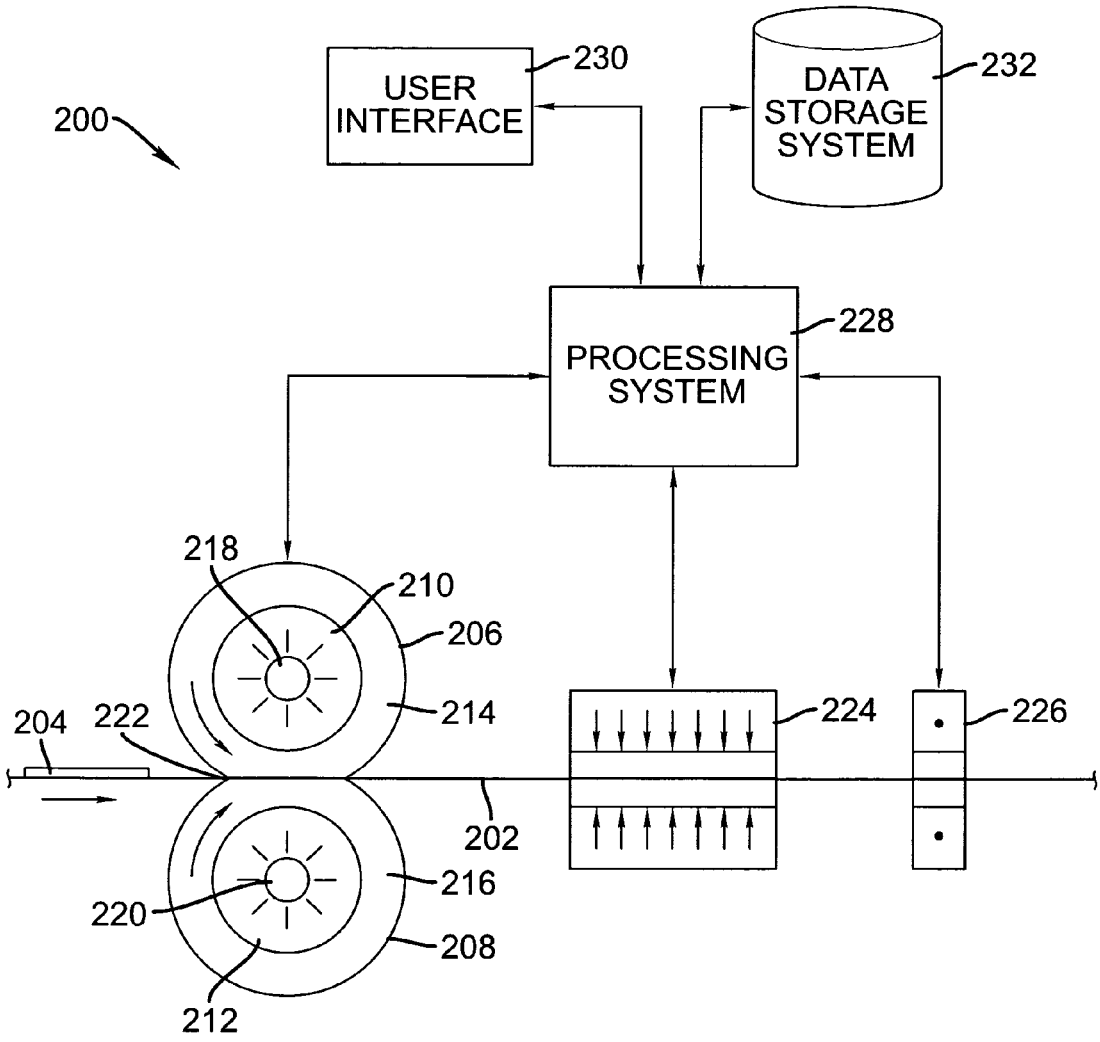
FIG. 2 illustrates an apparatus for optimizing a printing process, according to an embodiment of the present invention.

In the case of duplex printing, the substrate 204, after it exits the discharging device 226, is flipped over (not shown) by a region of the paper path 202 (not shown) and returns to the original position shown in FIG. 2 with its opposite side facing up. This opposite side then passes through the apparatus 200 so that the toner on such opposite side is fused.

Most or all of the devices in the apparatus 200, even those not shown in FIG. 2, but which are well known in the art, are communicatively connected to a processing system 228, which monitors and controls such devices. The processing system 228 is communicatively connected to a user interface 230 to interact with a user, as necessary. Further, the processing system 228 is communicatively connected to a data storage system 232, which the processing system 228 accesses to retrieve and store needed information.

The processing system 228 may include one or more processing devices and/or one or more computers. The phrase "processing device" and the term "computer" each is intended to include any device for processing data, and/or managing data, and/or handling data, whether implemented with electrical and/or magnetic and/or optical and/or biological components, and/or otherwise. The processing system 228 executes software and/or firmware instructions stored in the data storage system 232 to implement the processes described with respect to FIG. 4, below.

The data storage system 232 may include one or more computer-accessible memories. The data storage system 232 may be a distributed data-storage system including multiple computer-accessible memories communicatively connected via a plurality of computers and/or devices. On the other hand, the data storage system 232 need not be a distributed data-storage system and, consequently, may include one or more computer-accessible memories located within a single computer or device.

The phrase "computer-accessible memory" is intended to include any computer-accessible data storage device, whether volatile or nonvolatile, electronic, magnetic, optical, or otherwise, including but not limited to, floppy disks, hard disks, Compact Discs, DVDs, flash memories, ROMs, and RAMs.

The phrase "communicatively connected" is intended to include any type of connection, whether wired, wireless, or both, between devices, and/or computers, and/or programs in which data may be communicated. Further, the phrase "communicatively connected" is intended to include a connection between devices and/or programs within a single apparatus, and a connection between devices and/or programs located in different apparatuses. In this regard, although the data storage system 232 is shown separately from the processing system 228, one skilled in the art will appreciate that the data storage system 232 may be stored completely or partially within the processing system 228.

Figure 3:
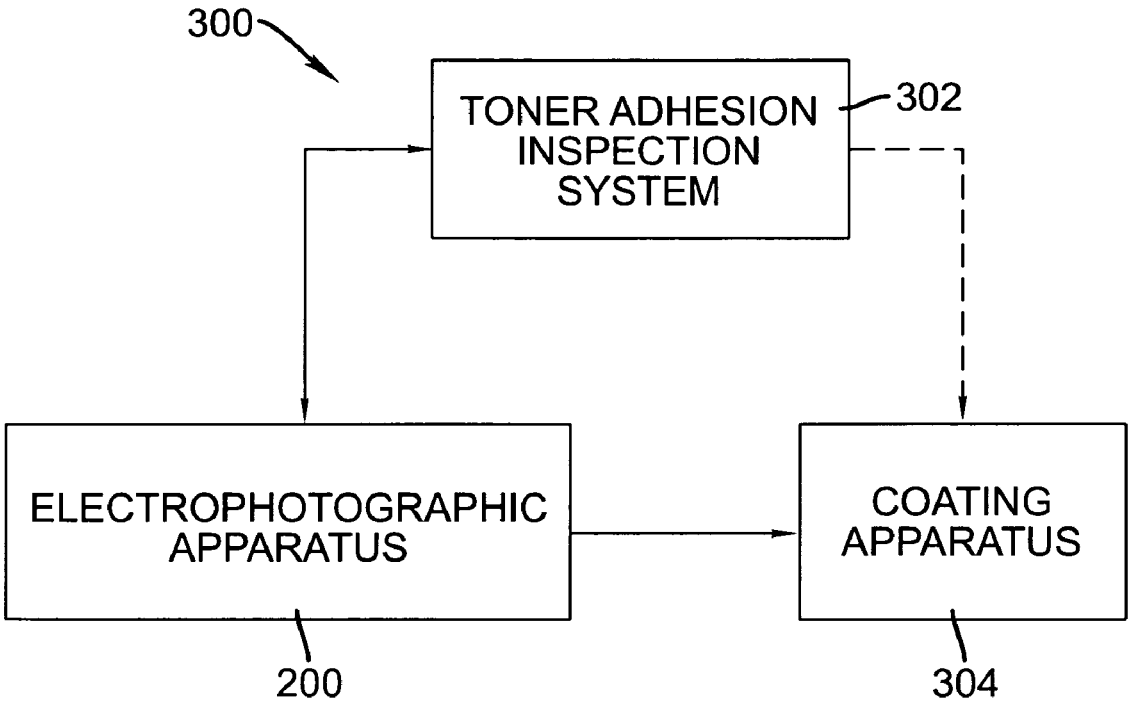
FIG. 3 illustrates a system for optimizing a printing process, according to an embodiment of the present invention.

FIG. 3 illustrates a system 300 for optimizing a printing process, according to an embodiment of the present invention. The system 300 includes the EP printing apparatus 200 described with reference to FIG. 2, above. The EP printing apparatus 200 is communicatively connected to a toner adhesion inspection system 302 and a finishing apparatus 304. The toner adhesion inspection system 302 may or may not be communicatively connected to the finishing apparatus 304.

As described in more detail below with reference to FIGS. 4, 6, 7, and 8, the toner adhesion inspection system 302 inspects one or more toner adhesion characteristics of a print ("test print"), from the EP printing apparatus 200. The toner adhesion inspection system 302 then provides feedback to the EP printing apparatus 200 used to adjust press parameters to improve the toner adhesion characteristics in a subsequent print ("print job") to be subjected to finishing by the finishing apparatus 304. According to an embodiment of the present invention, the toner adhesion inspection system 302 includes a user that physically inspects the toner adhesion characteristics of the test print. In another embodiment, the toner adhesion inspection system 302 includes one or more processing devices and accompanying tools and sensors that automatically inspect the toner adhesion characteristics of the test print. In this embodiment the toner adhesion inspection system 302 may include a device, such as the balanced beam scrape adhesion and mar tester, models pa-2197a & pa-2197b, by the Paul N. Gardner Co., Incorporated.

In the case where the toner adhesion inspection system 302 automatically inspects the toner adhesion characteristics of the test print, the toner adhesion inspection system 302 may be placed "in-line" with the EP printing apparatus 200, so that a test print from the EP printing apparatus 200 automatically is fed into the toner adhesion inspection system 302. According to this embodiment, a print job having many pages may be divided into two parts, a test print part and a final print part. The test print part may be the first "X" number of pages of the print job, and the final print part may be the remaining pages of the print job. After the test print part prints and at least a page of which is analyzed by the toner adhesion inspection system 302, the toner adhesion inspection system 302 may contemporaneously send its feedback to the EP apparatus 200, so that the press settings properly are adjusted prior to printing the final print part. It is preferable that the EP printing apparatus 200 print both the test print part and the final print part without interruption.

The finishing apparatus 304 forms a finish on a substrate printed by the EP apparatus 200. In an embodiment of the present invention, the finishing apparatus 304 is a glossing apparatus, such as, for example, the Eastman Kodak Company NexGlosser™. The finishing apparatus 304 may also be a UV coating apparatus or a lamination apparatus, or any other similar finishing apparatuses known in the art. The finishing apparatus 304 may be placed "in-line" with the EP apparatus 200, so that a document printed by the EP apparatus 200 automatically is fed into the finishing apparatus 304 for finishing. Optionally, the EP apparatus 200, the toner adhesion inspection system 302, and the finishing apparatus 304 are all placed "in-line" adjacent to one another. If the toner adhesion inspection system 302 is located in between the EP apparatus 200 and the finishing apparatus 304, pages that are not inspected by the toner adhesion inspection system 302 may pass through the toner adhesion inspection system 302 unprocessed and into the finishing apparatus 304 for finishing. Pages that are inspected by the inspection system 302 may be discharged into an exit tray for destruction if they do not have proper toner adhesion characteristics or may be passed onto the finishing apparatus 304 for finishing if they do have proper toner adhesion characteristics.

Figure 4:
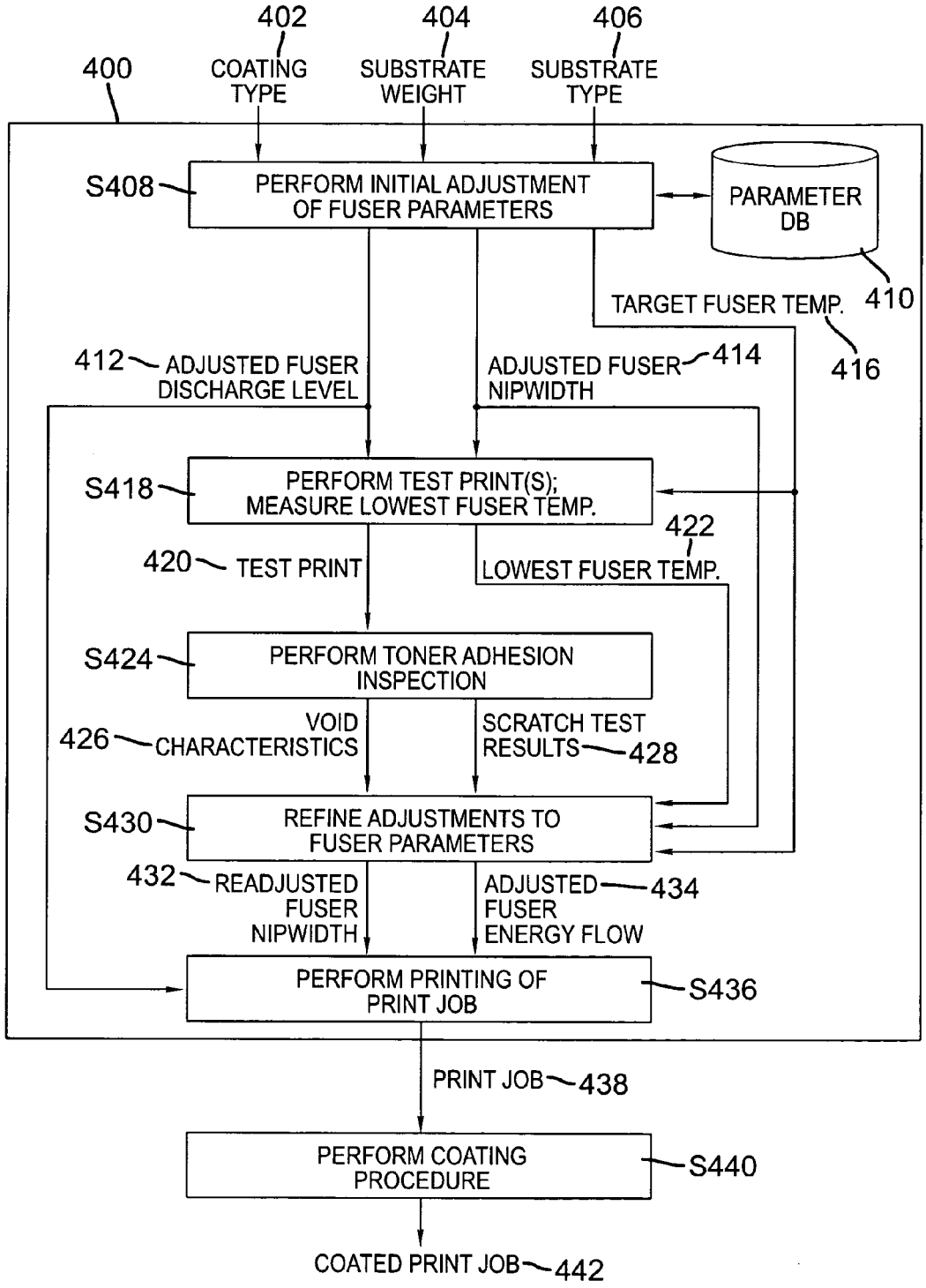
FIG. 4 illustrates a method for optimizing a printing process, according to an embodiment of the present invention.

FIG. 4 illustrates a process 400 for optimizing a printing process implemented by the EP apparatus 200 and the toner adhesion inspection system 302 shown in FIGS. 2 and 3, according to an embodiment of the present invention. Inputs into the process 400 may include at least one of a finishing type 402 to be applied to a print job 438 by the finishing apparatus 304, a substrate weight 404, a substrate type 406, and a substrate surface type 407 to be used for printing a test print 420 and the print job 438. Examples of a finishing type 402, according to an embodiment of the present invention, include a gloss finish, a UV coating, and a laminate coating. Examples of the substrate weight 404, according to an embodiment of the present invention, include weights between approximately 118 grams per square meter to 352 grams per square meter. Examples of a substrate type 406, according to an embodiment of the present invention are paper, transparency, foil, self-adhesive, etc. Examples of a substrate surface type 407, according to an embodiment of the present invention are matte, uncoated, glossy coated, cast-coated, etc. One skilled in the art will appreciate, however, that the invention is not limited to these substrate weights, types, and surface types, and that other substrate weights, types, and surface types may be used.

These inputs 402, 404, 406, and 407 may be provided to the processing system 228 via the user interface 230 or via data stored in the data storage system 232. Step S408 receives these inputs and accesses a parameter database 410 to determine one or more initial press adjustments ("test print adjustments") to be used for performing a test print. The parameter database 410 may be stored within the data storage system 232 in FIG. 2. Based upon at least one of the input finishing type 402, the substrate weight 404, and the substrate type 406, and the substrate surface type 407, the parameter database 410 returns the test print adjustments. According to an embodiment of the present invention, the test print adjustments include an adjusted fuser discharge level 412, an adjusted fuser nipwidth 414, and a target fuser temperature 416. The adjusted fuser discharge level 412 indicates a deviation from a normal fuser discharge level to be used during printing of a test print. The adjusted fuser nipwidth 414 is a deviation from a normal amount of pressure applied to a test print between the fuser roller 206 and the pressure roller 208. The target fuser temperature 416 is a temperature of the fuser roller 206 that is predicted to achieve proper fusing for the finishing performed by the finishing apparatus 304.

In order to determine the values of the adjusted fuser discharge level 412, the adjusted fuser nipwidth 414, and the target fuser temperature 416, the contents of the parameter database 410 may be in the form of a substrate catalog. The substrate catalog indicates fuser nipwidth, fuser discharge levels, and fuser temperatures for each type, surface type, and weight of substrate, as well as the finishing type to be applied to the substrate.

For example, for an uncoated substrate surface type 407 to be subjected to a glossing finishing procedure type 402, it has been determined that the adjusted fuser nipwidth 414 should be about −2,000 μm from a standard nipwidth. The standard nipwidth, which, depending upon the design hardness of the fuser roller 206 and the pressure roller 208, could be approximately 18 mm and provide for an over-fused condition. For a paper substrate type 406 and a matte substrate surface type 407 to be subjected to a glossing finishing procedure type 402, it has been determined that the adjusted fuser nipwidth 414 should be about −3,000 μm from a standard nipwidth. And, for a paper substrate type 406 and a glossy substrate surface type 407 to be subjected to a glossing finishing procedure type 402, it has been determined that the adjusted fuser nipwidth 414 should be about −5,000 μm from a standard nipwidth. Further, for a paper substrate type 406 and a glossing finishing type 402 and a paper substrate type 407, regardless of the substrate surface type 407 and the substrate weight 404, it has been determined that discharger settings 412 should be increased when an image is on both sides of the substrate. In the case of a single sided image, it has been determined that the discharger settings need not be changed. It should be noted that the examples in this paragraph are adjustments that may be applied for one particular set of conditions/mechanical arrangement. One skilled in the art, however, will appreciate that the invention is not limited to these particular adjustments and that other settings may be used for other conditions or mechanical arrangements.

Although only adjustments to the fuser discharge level 412 and the adjusted fuser nipwidth 414 are shown as being output from step S408, other adjustments may be made, such as an initial adjustment to fuser energy flow to the lamp 218, which adjusts the temperature of the fuser roller 206.

The adjustments output from step S408 provide an approximation of the optimal press settings needed to produce proper fusing of a print job to be subjected to a subsequent finishing procedure. According to an embodiment of the present invention, one or more of these adjustments are further refined by performing and analyzing a test print printed using the adjustments from step S408. In particular, at step S418, a test print 420 is printed by the EP apparatus 200 using the test print adjustments (e.g., adjustments 412 and 414). Advantageously, the test print 420 is printed using the same substrate type, surface type, and weight that will be used for printing the print job 438.

The test print may contain the most stressful toner laydown, as this situation will be the most likely to result in cold offset, i.e., toner that does not adhere to the substrate leading to density voids. The most stressful toner laydown may include between about 280% and 320% coverage in a four or five color process, where 100% of the color black is laid down and about 60% of each of the colors yellow, cyan, and magenta are laid down. If a fifth color is used, none of it need be laid down, so long as about 280% coverage is met.

During printing of the test print 420, the temperature of the fuser roller 206 is monitored by the processing system 228. In one embodiment of the present invention, the lowest fuser roller temperature 422 is recorded during printing of the test print 420. According to an embodiment of the present invention, fuser temperature is measured during a period of time when the lowest fuser temperature is expected to occur. Generally, the lowest fuser roller temperature 422 occurs during the early stages of the print run. When the lowest temperature occurs will be dependant upon the fusing system design. Therefore, the test print run length (step S418) should be adjusted based on the fusing system's temperature control performance. However, the lowest fuser temperature 422 may occur at any time during the many pages printed at step S418. Therefore, the temperature may be monitored during the entire run.

Output from step S418 is the test print 420, which may be one of many pages printed at step S418. Also output from step S418 is the measured lowest fuser temperature 422 during the test print 420. The test print 420 is passed on to the toner adhesion inspection system 302 at step S424 to determine one or more characteristics of toner adhesion in the test print. A goal of step S424 is to determine one or more characteristics of the adhesiveness of the toner to the substrate of the test print 420. In the case of gloss finishing, the toner adhesion inspection system 302 determines, at step S424 whether there is offset, also known as toner density voids, in the test print 420, and if no offset exists, the toner adhesion inspection system 302 determines how easily toner scratches off of the test print 420 at step S424.

Figure 6:
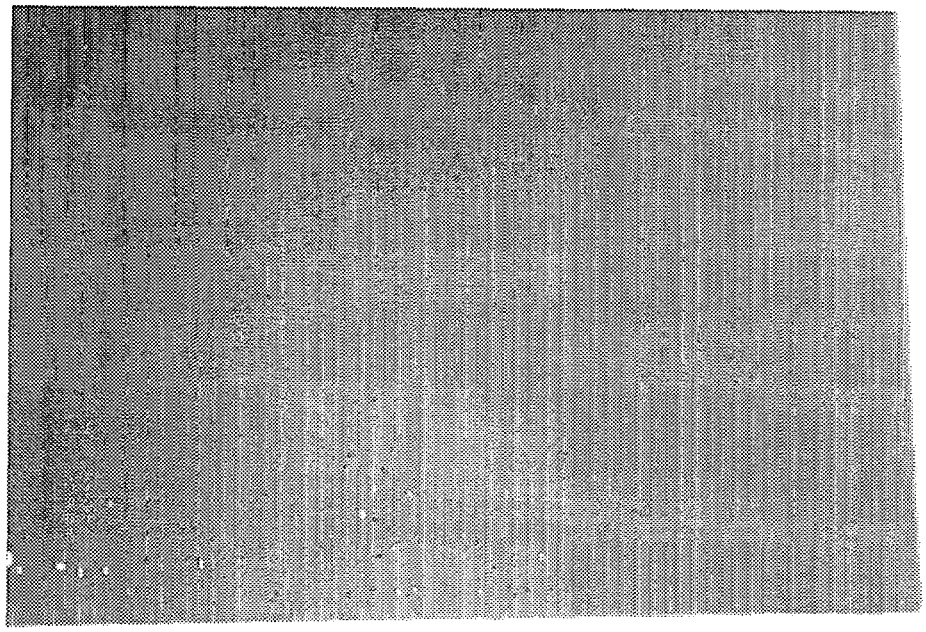
FIG. 6 illustrates poor toner adhesion characteristics exhibiting small or few density voids.
Figure 7:
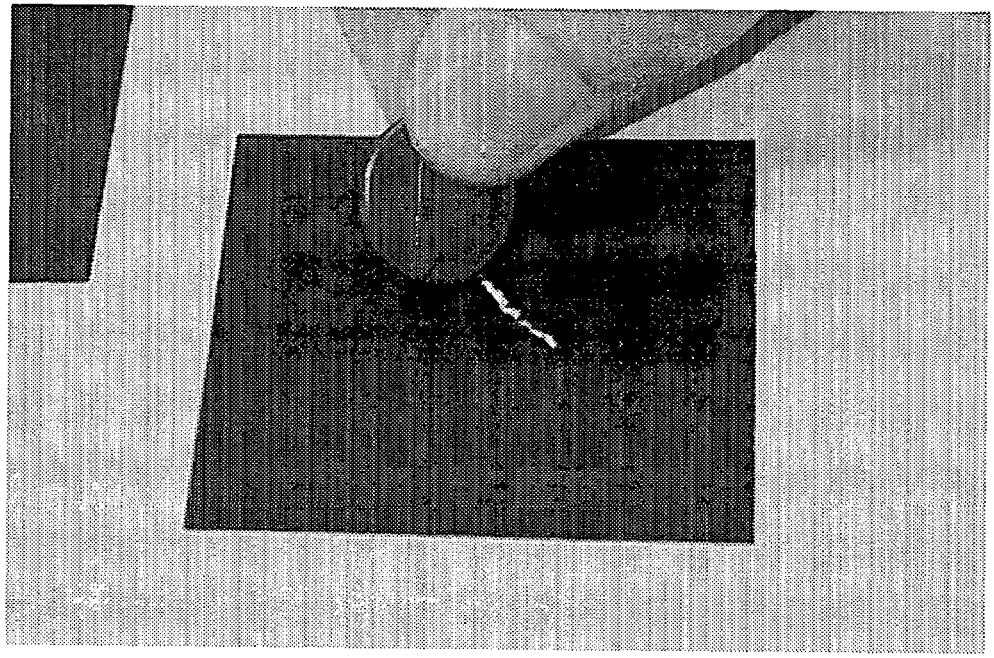
FIG. 7 illustrates poor toner adhesion characteristics exhibiting toner that scratches off easily.

To elaborate, FIGS. 6 and 7 illustrate large/many density voids and small/few density voids, respectively. FIG. 7 illustrates toner that scratches off easily. FIG. 7 also illustrates that testing for how easily toner scratches off may be performed by a user using a scratching device, such as a coin, a fingernail, or a paper clip. Alternatively, the toner adhesion inspection system 302 may include a mechanical apparatus that includes a device that performs scratching, such as the balanced beam scrape adhesion and mar tester, models pa-2197a & pa-2197b, by the Paul N. Gardner Co., Incorporated. Density voids, as shown in FIGS. 6 and 7 illustrate under-fused toner. On the other hand, toner that does not scratch off easily indicates over-fused toner. What is desired is toner that adheres without density voids and scratches off easily.

Step S424 outputs inspected void characteristics 426 and the scratch test results 428 to step S430. Also input to step S430 is the target fuser temperature 416, the adjusted fuser nipwidth 414, and the lowest measured fuser temperature 422. Based upon this information, step S430 outputs a readjusted fuser nipwidth 432 and an adjusted fuser energy flow 434. According to an embodiment of the present invention, the outputs of step S430 are determined by the processing system 228 using a table, which may be stored in the data storage system 302, shown, for example, in FIG. 8. It is to be noted, however, that the values shown in FIG. 8 are for example only, and that the invention is not limited to these particular adjustments.

FIG. 8 illustrates that, in the case of a glossing finishing procedure, (a) if the void characteristics 426 indicate that no voids are present in the test print 420, i.e., that no offset exists in the test print 420, (b) if the scratch test results 428 indicate that the dry ink on the test print 420 scratches off easily, as shown in FIG. 7, and (c) if the lowest fuser temperature 422 is within 3° C. of the target fuser temperature 416, then ideal fusing conditions were present during printing of the test print 420 and no additional press setting adjustments are needed.

Figure 5:
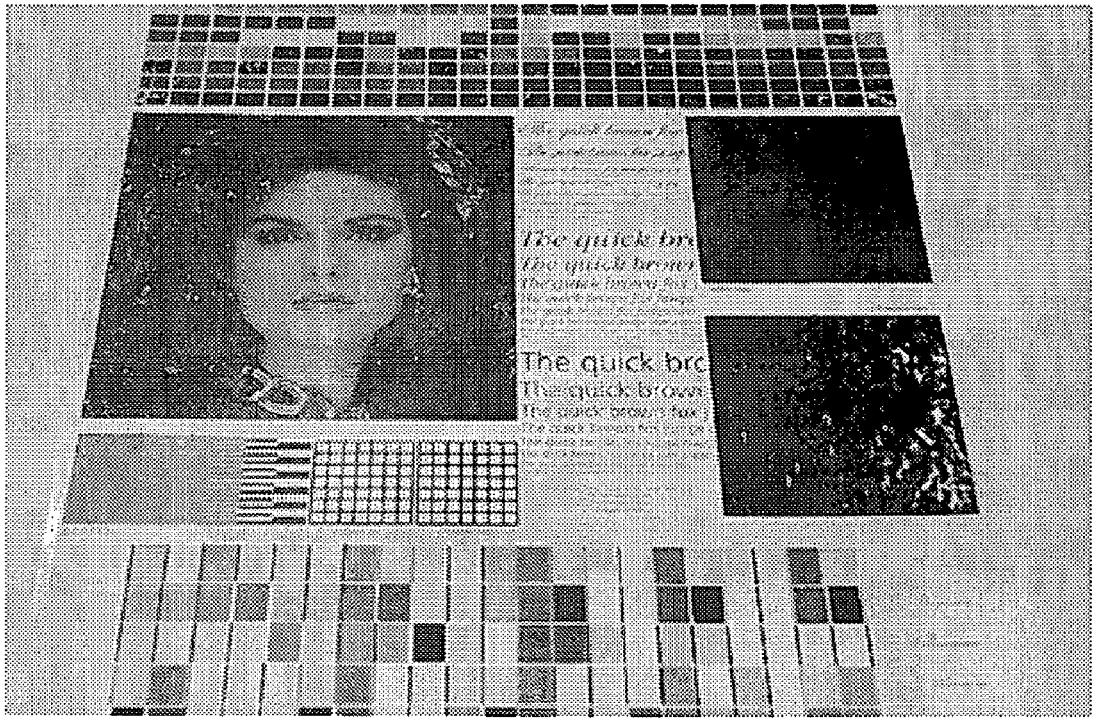
FIG. 5 illustrates poor toner adhesion characteristics exhibiting large or many density voids.

FIG. 8 also illustrates that, in the case of a glossing finishing procedure, if the void characteristics 426 indicate that voids are present in the test print 420, i.e., that offset is present, then insufficient fusing occurred during printing of the test print 420. Accordingly, more fusing needs to occur when printing the print job 438 and fuser nipwidth and fuser energy flow generally are increased, i.e., readjusted fuser nipwidth 432 and adjusted fuser energy flow 434 are positive). The exception, in the embodiment of FIG. 8, is when lowest fuser temperature 422 is above the target fuser temperature 416 by more than 3° C. and small or few density voids exist. In this case, the energy flow to the lamp 218 in the fuser roller 206 is decreased, i.e., adjusted fuser energy flow 434 is negative. Large or many density voids indicates less fusing than small or few density voids. Consequently, larger (more positive) adjustments to the fuser nipwidth and the fuser energy flow occur when large or many density voids exist in the test print (as shown in FIG. 5) than occur when small or few density voids exist in the test print 420 (as shown in FIG. 6).

When the void characteristics 426 indicate that no density voids are present, i.e., there is no offset, and when the scratch test results 428 indicate that the dry ink on the test print 420 does not or is difficult to scratch off, then a state of over-fusing of the test print 420 has occurred. Accordingly, adjustments are made to reduce the amount of fusing that occurs during printing of the print job 438. For example, fuser nipwidth 414 is decreased, i.e., readjusted fuser nipwidth 432 is negative, and fuser energy flow generally is decreased, i.e., adjusted fuser energy flow 434 is negative. The exception is when the lowest fuser temperature 422 is below the target fuser temperature 416 by more than 3° C. In this case, the fuser energy flow is increased, i.e., adjusted fuser energy flow 434 is positive. The more difficult it is to scratch the dry ink off of the test print 420, the more over-fusing has occurred during printing of the test print 420. Consequently, larger (more negative) adjustments to the fuser nipwidth and the fuser energy flow occur when the dry ink does not scratch off of the test print 420 than occur when the dry ink scratches off with some difficulty.

Step S436 receives as input print job adjustments, which may include one or more refined adjustments to the test print adjustments input into step S418. According to an embodiment of the invention, the print job adjustments input into step S436 include the readjusted fuser nipwidth 432 and the adjusted fuser energy flow 434 from step S430, as well as the adjusted fuser discharge level 412 from step S408. These inputs are used as press settings when printing the print job 438 with the EP Apparatus 200 to obtain optimal fusing characteristics for the subsequent finishing procedure performed at step S440 by the finishing apparatus 304. Output from step S440 is the coated print job 442.

In an embodiment of the present invention, duplex printing is performed. In this embodiment, the side of the print job 442 to be finished is printed last by the EP Apparatus 200, so that optimal fusing of that side is ensured by the process 400 described above.

It is to be understood that the exemplary embodiments are merely illustrative of the present invention and that many variations of the above-described embodiments can be devised by one skilled in the art without departing from the scope of the invention. For example, although portions of the process 400 are described as being performed by the processing system 228, many of the functions performed by the processing system 228 may be performed by one or more users instead. For instance, a user may manually reference a substrate catalog and manually calculate the test print adjustments used to perform the test print 420 at step S418. Further, a user may manually perform the toner adhesion inspection, review a table such as that shown in FIG. 8, and arrive at the print job adjustments used at step S430 to print the print job 438. In this situation, the operator may be instructed on how to perform the processes described herein by instructions embodied in a computer-accessible data file stored in a computer-accessible memory, such as an Adobe PDF document, a Microsoft Word document, or a Microsoft Excel Spreadsheet. Further, although some of the specific examples provided herein apply to the context of performing gloss finishing, one skilled in the art will appreciate that the invention applies to other finishing processes, such as, UV coating, lamination, and other similar finishing processes. It is therefore intended that any and all such variations be included within the scope of the following claims and their equivalents.

PARTS LIST

101 illustration
102 toner particles
103 image substrate
104 illustration
105 toner particles
106 release fluid
107 illustration
108 toner particles
109 seams

200 EP printing apparatus
202 paper path
204 substrate
206 fuser roller
208 pressure roller
210 aluminum core
212 aluminum core
214 rubber exterior
216 rubber exterior
218 internal lamp
220 internal lamp
222 nipwidth
224 cooling device
226 discharging device
228 processing system
230 user interface
232 data storage system
300 system
302 inspection system
304 finishing apparatus
400 process
402 finishing type
404 substrate weight
406 substrate type
407 substrate surface type
410 parameter database
412 adjusted fuser discharge level
414 adjusted fuser nipwidth
416 target fuser temperature
420 test print
422 lowest fuser roller temperature
426 void characteristics
428 scratch test results
432 re-adjusted fuser nipwidth
434 adjusted fuser energy flow
38 print job
442 coated print job
S408 step
S418 step
S424 step
S430 step
S436 step
S440 step

What is claimed is:

1. A method for optimizing a printing process, the method performed at least in part by a computer and comprising the steps of:

receiving toner adhesion information identifying at least one of (a) a characteristic of toner voids present in a printed image, and (b) an indication of how easily toner may be removed from the printed image; and adjusting a fuser pressure, a fuser temperature, or both based at least upon the toner adhesion information, wherein the adjusted fuser pressure, the adjusted fuser temperature, or both are used for printing a print job prior to performing a finishing procedure on the print job, the adjusting step improving a performance of the finishing procedure when performed on the print job.

2. The method of claim 1, further comprising the steps of:

printing the print job ("printed print job") using the adjusted fuser pressure, the adjusted fuser temperature, or both; and subjecting the printed print job to the subsequent finishing procedure.

3. The method of claim 1, wherein the finishing procedure is a glossing procedure.

4. A method for improving a performance of a finishing procedure performed on a print job, the method comprising the steps of:

performing a test print of an image with a printing device;

receiving toner adhesion information identifying a toner adhesion characteristic of the test print in a state when the test print has not been subjected to the finishing procedure; and identifying an adjustment ("print job adjustment"), based at least upon the toner adhesion information, to a fuser pressure, a fuser temperature, or both, to be used for printing the print job prior to performing the finishing procedure on the print job, the adjustment configured to improve the toner adhesion characteristic and improve a performance of the finishing procedure when performed on the print job.

5. The method of claim 4, further comprising the steps of:

receiving parameter information identifying at least one of a substrate weight, a substrate type, a substrate surface type, and a type of finishing procedure; and identifying an adjustment ("test print adjustment") to a fuser pressure, a fuser discharge level, or both, based at least upon the parameter information, the test print adjustment to be used for performing the test print.

6. The method of claim 5, wherein the test print adjustment includes an adjustment ("test print fuser pressure adjustment") to the fuser pressure to be used for performing the test print, wherein the print job adjustment includes an adjustment to the test print fuser pressure adjustment ("adjusted test print fuser pressure adjustment"), and wherein the adjusted test print fuser pressure adjustment is used for printing the print job prior to performing the finishing procedure on the print job.

7. The method of claim 5, wherein the test print adjustment includes an adjustment to the fuser discharge level ("adjusted fuser discharge level") used for performing the test print, and the adjusted fuser discharge level also is used for printing the print job prior to performing the finishing procedure on the print job.

8. The method of claim 4, further comprising the steps of:

recording a fuser temperature during the step of performing a test print; and generating temperature information by comparing the recorded fuser temperature to a target fuser temperature, wherein the identifying step identifies the print job adjustment based at least upon the toner adhesion information and the temperature information, and the print job adjustment includes an adjustment to the fuser temperature based at least upon the temperature information.

9. The method of claim 8, wherein the recording step records the fuser temperature at one time or over a defined period of time when an approximately minimum fuser temperature occurs or is expected to occur.

10. The method of claim 4, wherein the toner adhesion information identifies at least one of (a) a characteristic of toner voids present in the test print, and (b) a relative indication of how easily toner may be removed from the test print.

11. The method of claim 4, wherein the finishing procedure is a glossing procedure.

12. The method of claim 4, wherein the print job adjustment includes an adjustment to the fuser pressure, and wherein the adjustment is carried out by adjusting a fuser nipwidth.

13. The method of claim 4, wherein the print job adjustment includes an adjustment to the fuser temperature, and wherein the adjustment is carried out by adjusting a fuser energy flow.

14. The method of claim 4, wherein the print job adjustment ensures that release fluid build-up on a substrate used to print the print job does not substantially adversely affect the subsequent finishing procedure.

15. The method of claim 4, further comprising the steps of:

printing the print job ("printed print job") using the print job adjustment; and subjecting the printed print job to the subsequent finishing procedure.

16. The method of claim 15, wherein the print job is a duplex print job, and a last side printed of the printed print job is subjected to the subsequent finishing procedure.

17. A printing system comprising:

an electrophotographic printing apparatus configured at least to print a test print of an image and to print a final print of the image;

a finishing device configured at least to form a finish on the final print of the image; and a toner adhesion inspection system communicatively connected to the electrophotographic printing apparatus and configured to transmit toner adhesion information to the electrophotographic printing apparatus identifying a toner adhesion characteristic of the test print in a state when the test print has not been finished by the finishing device, wherein the electrophotographic printing apparatus prints the final print using an adjusted fuser pressure, an adjusted fuser temperature, or both, based at least upon the toner adhesion information, the adjustment(s) configured to improve the toner adhesion characteristic and improve performance of the finishing device when forming the finish on the final print of the image.

18. Instructions stored in a computer-accessible memory for executing a method for improving a performance of a finishing procedure performed on a print job, wherein the instructions comprise:

instructions for performing a test print of an image with a printing device;

instructions for providing toner adhesion information identifying a toner adhesion characteristic of the test print in a state when the test print has not been subjected to the finishing procedure; and instructions for causing identification of an adjustment ("print job adjustment") based at least upon the toner adhesion information, to a fuser pressure, a fuser temperature, or both, to be used for printing the print job prior to performing the finishing procedure on the print job, the adjustment improving the toner adhesion characteristic and improving a performance of the finishing procedure when performed on the print job.

19. The instructions stored in a computer-accessible memory of claim 18, further comprising:

instructions for printing the print job ("printed print job") using the adjusted fuser pressure, the adjusted fuser temperature, or both; and subjecting the printed print job to the subsequent finishing procedure.

20. Instructions stored in a computer-accessible memory of claim 18, further comprising:

instructions for providing parameter information identifying at least one of a substrate weight, a substrate type, a substrate surface type, and a type of finishing procedure; and instructions for identifying an adjustment ("test print adjustment") to a fuser pressure, a fuser discharge level, or both, based at least upon the parameter information, the test print adjustment to be used for performing the test print.

* * * * *